US010370954B2

(12) United States Patent
Heinonen et al.

(10) Patent No.: US 10,370,954 B2
(45) Date of Patent: Aug. 6, 2019

(54) METHOD FOR SURVEYING DRILL HOLES, DRILLING ARRANGEMENT, AND BOREHOLE SURVEY ASSEMBLY

(71) Applicant: ROBIT OYJ, Lempaala (FI)

(72) Inventors: Mikko Heinonen, Tampere (FI); Harri Sjoholm, Kangasala (FI); Jussi Rautiainen, Valkeakoski (FI); Mikko Mattila, Yongsan-gu (KR); Jori Montonen, Tampere (FI)

(73) Assignee: ROBIT OYJ, Lempäälä (FI)

( * ) Notice: Subject to any disclaimer, the term of this patent is extended or adjusted under 35 U.S.C. 154(b) by 961 days.

(21) Appl. No.: 14/426,702

(22) PCT Filed: Sep. 5, 2013

(86) PCT No.: PCT/FI2013/050858
§ 371 (c)(1),
(2) Date: Mar. 6, 2015

(87) PCT Pub. No.: WO2014/037619
PCT Pub. Date: Mar. 13, 2014

(65) Prior Publication Data

US 2015/0240632 A1 Aug. 27, 2015

(30) Foreign Application Priority Data

Sep. 6, 2012 (FI) ..... 20125921

(51) Int. Cl.
*E21B 47/01* (2012.01)
*E21B 47/12* (2012.01)
(Continued)

(52) U.S. Cl.
CPC ..... *E21B 47/01* (2013.01); *E21B 1/00* (2013.01); *E21B 21/10* (2013.01);
(Continued)

(58) Field of Classification Search
CPC . E21B 1/00; E21B 47/00; E21B 47/01; E21B 47/011; E21B 47/12; E21B 47/124; E21B 41/0085
See application file for complete search history.

(56) References Cited

U.S. PATENT DOCUMENTS 3,149,490 A 9/1964 Clements et al.
3,714,831 A 2/1973 Quichaud et al.
(Continued)

FOREIGN PATENT DOCUMENTS

CN 1034405 A 8/1989
CN 101235869 A 8/2008
(Continued)

OTHER PUBLICATIONS

International Search Report (PCT/ISA/210) dated Aug. 28, 2014, by the European Patent Office as the International Searching Authority for International Application No. PCT/FI2013/050858.
(Continued)

*Primary Examiner* — Giovanna C Wright
*Assistant Examiner* — Tara E Schimpf
(74) *Attorney, Agent, or Firm* — Buchanan Ingersoll & Rooney PC

(57) ABSTRACT

A method is disclosed for surveying drill holes with a drilling arrangement and borehole survey assembly. The method can include providing a drill tool having at least one drill rod and a drill bit assembly, and providing a borehole survey tool having a sensor) for measuring a borehole. In the method a drill tool having a central flushing channel for conducting flushing fluid to the drill bit assembly is used, and the borehole survey tool is arranged in the central flushing channel so that flushing fluid can flow in the central flushing channel past the borehole survey tool.

26 Claims, 4 Drawing Sheets

Figure 1:
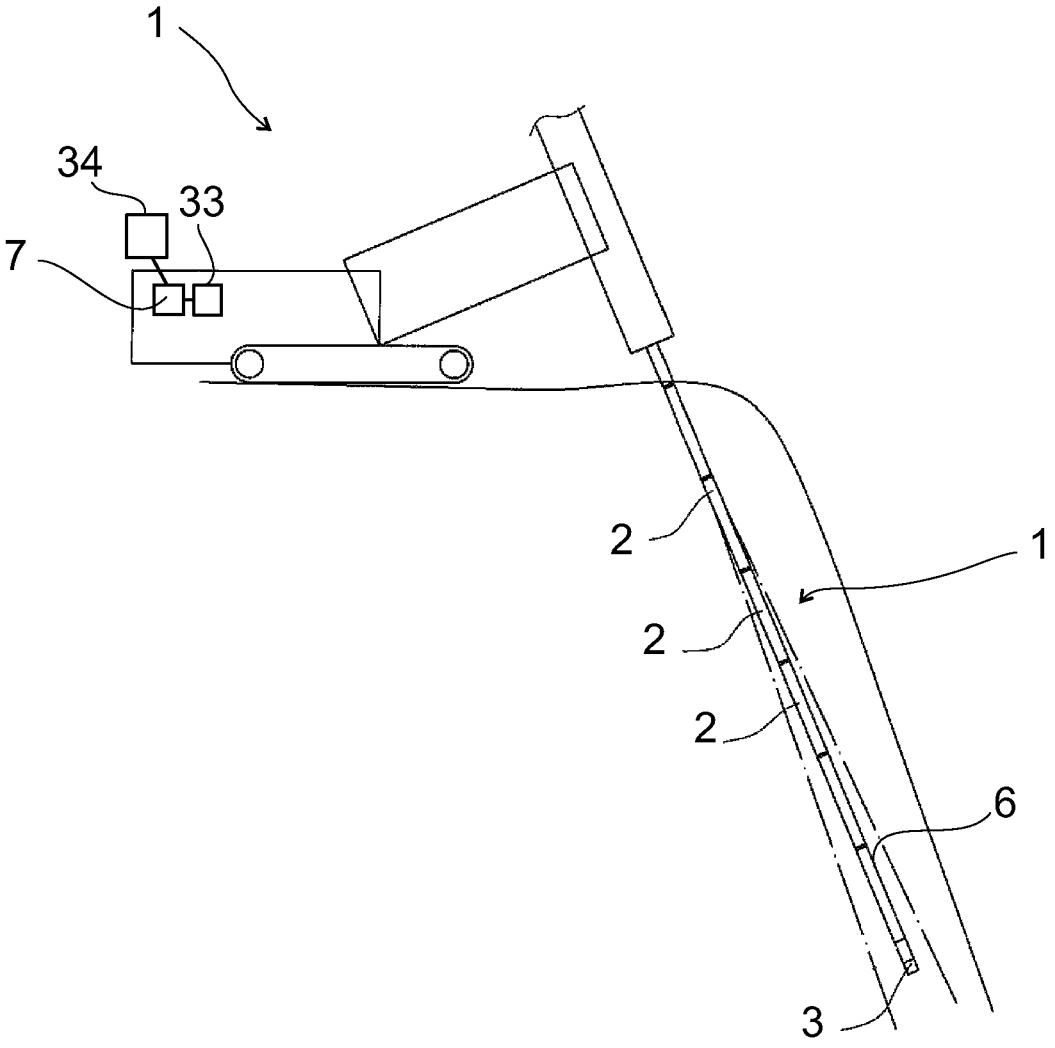

(51) Int. Cl.

| | |
|---|---|
| ***E21B 47/02*** | (2006.01) |
| ***E21B 1/00*** | (2006.01) |
| ***E21B 41/00*** | (2006.01) |
| ***E21B 21/10*** | (2006.01) |
| ***E21B 49/00*** | (2006.01) |

(52) U.S. Cl.

CPC ..... *E21B 41/0085* (2013.01); *E21B 47/011* (2013.01); *E21B 47/02* (2013.01); *E21B 47/12* (2013.01); *E21B 47/124* (2013.01); *E21B 49/005* (2013.01)

(56) References Cited

U.S. PATENT DOCUMENTS

| | | | | |
|---|---|---|---|---|
| 4,630,809 | A * | 12/1986 | Duckworth | E21B 17/07 267/125 |
| 4,716,976 | A * | 1/1988 | Isakov | E21B 10/38 175/415 |
| 4,879,463 | A | 11/1989 | Wraight et al. | |
| 5,295,548 | A | 3/1994 | Yuasa et al. | |
| 5,680,906 | A | 10/1997 | Andrieux et al. | |
| 6,367,565 | B1 * | 4/2002 | Hall | E21B 4/14 175/296 |
| 6,705,415 | B1 | 3/2004 | Falvey et al. | |
| 7,712,548 | B2 | 5/2010 | Moessnang | |
| 8,011,447 | B2 | 9/2011 | Keniston et al. | |
| 8,783,377 | B2 | 7/2014 | Baumann et al. | |
| 2001/0012703 | A1 | 8/2001 | Wurm | |
| 2004/0040751 | A1 | 3/2004 | Falvey et al. | |
| 2005/0006143 | A1 | 1/2005 | Uitto | |
| 2007/0151761 | A1 | 7/2007 | Keniston et al. | |
| 2008/0185165 | A1 | 8/2008 | Moessnang | |
| 2008/0271923 | A1 | 11/2008 | Kusko | |
| 2009/0038848 | A1 | 2/2009 | Garcia-Osuna | |
| 2009/0151967 | A1 | 6/2009 | Haas et al. | |
| 2010/0258351 | A1 | 10/2010 | Hooks et al. | |
| 2010/0307783 | A1 | 12/2010 | Baumann et al. | |
| 2013/0000399 | A1 * | 1/2013 | Lilly | E21B 47/011 73/152.58 |
| 2013/0175091 | A1 | 7/2013 | Henriksson | |

FOREIGN PATENT DOCUMENTS

| | | | |
|---|---|---|---|
| CN | 101525997 | A | 9/2009 |
| CN | 101903136 | A | 12/2010 |
| CN | 201661248 | U | 12/2010 |
| CN | 101941199 | A | 1/2011 |
| CN | 201874554 | U | 6/2011 |
| JP | H05118186 | A | 5/1993 |
| JP | 2000160975 | A | 6/2000 |
| JP | 2002047885 | A | 2/2002 |
| JP | 2002536576 | A | 10/2002 |
| WO | 96/01359 | A2 | 1/1996 |
| WO | WO2012/039666 | A1 | 3/2012 |

OTHER PUBLICATIONS

Search Report dated Jun. 17, 2013, by the National Board of Patents and Registration of Finland in corresponding Patent Application No. 20125921.

Opposition filed May 31, 2018, against Australian Patent Application No. 2013311479 in the Australian Patent Office.

* cited by examiner

METHOD FOR SURVEYING DRILL HOLES, DRILLING ARRANGEMENT, AND BOREHOLE SURVEY ASSEMBLY

FIELD OF THE INVENTION

The invention relates to a method for surveying drill holes.

The invention also relates to a drilling arrangement for percussive drilling.

The invention relates also to a borehole survey assembly for use in a method for percussive drilling and/or in an arrangement for percussive drilling.

In drilling it is important to have information about the depth and the direction of the boreholes. For this purpose various borehole survey tools and methods are known in the art by which it is possible to obtain information about the depth and the direction of boreholes.

Publication U.S. Pat. No. 8,011,447 presents a method of surveying drill holes, typically for use in underground mining situations where the holes are bored using a top hammer drill rig, utilizes a survey tool located adjacent the drill bit which is used to log position readings as the drill string is withdrawn from the hole after the drilling operation. In this manner, it is possible to log the actual hole bored by the drill string in real time as the drilling operation proceeds, and show deviation from intended hole positions. The survey tool typically includes an inertial survey package, a power source, and a data logger with the survey package selected from the group comprising commercially known inertial known survey packages, for superior characteristics of resistance to vibration and impact. The survey tool is maintained in a sleeping mode while drilling is undertaken, and activated to provide position data as the drill string is progressively withdrawn from the actual hole path.

OBJECTIVE OF THE INVENTION

The object of the invention is to provide a method for surveying drill holes, a drilling arrangement, and a borehole survey tool assembly.

SHORT DESCRIPTION OF THE INVENTION

The method comprises a first providing step for providing a drill tool comprising at least one drill rod and a drill bit assembly. The method comprises additionally a second providing step for providing a borehole survey tool comprising sensor means for measuring a borehole. The method comprises an arranging step for arranging the borehole survey tool within the drill tool. The method comprises a drilling step for drilling with the drill tool a borehole by a drilling process including at least percussive drilling. The method comprises a measuring step for measuring the borehole by means of the sensor means of the borehole survey tool to obtain data of the borehole. The method comprises a processing step for processing data of the borehole with a data processing means to obtain borehole status information. In the method, a drill tool comprising a central flushing channel for conducting flushing fluid to the drill bit assembly is used and the borehole survey tool is in the arranging step arranged in the central flushing channel so that flushing fluid can flow in the central flushing channel past the borehole survey tool. The arranging step includes preferably, but not necessarily, suspending the borehole survey tool in the central flushing channel of the drill tool between damping means. Such damping means comprises preferably, but not necessarily at least one of the following: spring means, such as conical springs, made of a wire or the like having a thickness between 0.5 and 3.0 mm, hydraulic damping means and pneumatic damping means. Such damping means can for example comprise spring means, such as conical springs, made of a wire or the like having a thickness, such as a diameter, between 0.5 and 3.0 mm, preferable between 1.0 and 2.5 mm, more preferable between 1.5 and 2.0 mm, for example 1.8 mm.

The drilling arrangement comprises a drill tool for drilling boreholes. The drill tool comprises at least one drill rod and a drill bit assembly. The drilling arrangement comprises a borehole survey tool comprising sensor means for measuring a borehole drilled by the drill tool to obtain data of a borehole drilled by the drill tool, wherein the borehole survey tool is arranged within the drill tool. The drilling arrangement comprises data processing means for processing data of the borehole to obtain borehole status information. The drill tool comprises a central flushing channel for conducting flushing fluid to the drill bit assembly and the borehole survey tool is arranged in the central flushing channel so that fluid can flow in the central flushing channel past the borehole survey tool. The borehole survey tool is preferably, but not necessarily, suspended in the flushing channel between damping means. The damping means used in the method comprises preferably, but not necessarily at least one of the following: spring means, such as conical springs, made of a wire or the like having a thickness between 0.5 and 3.0 mm, hydraulic damping means and pneumatic damping means. The damping means used in the method can for example comprise spring means, such as conical springs, made of a wire or the like having a thickness, such as a diameter, between 0.5 and 3.0 mm, preferable between 1.0 and 2.5 mm, more preferable between 1.5 and 2.0 mm, for example 1.8 mm.

The borehole survey assembly comprises a borehole survey tool containing sensor means for collecting data of a borehole. The borehole survey assembly comprises additionally damping means for suspending the borehole survey tool in a central flushing channel of a drill tool for percussive drilling between said damping means. Such damping means comprises preferably, but not necessarily at least one of the following: spring means, such as conical springs, made of a wire or the like having a thickness between 0.5 and 3.0 mm, hydraulic damping means and pneumatic damping means. Such damping means can for example comprise spring means, such as conical springs, made of a wire or the like having a thickness, such as a diameter, between 0.5 and 3.0 mm, preferable between 1.0 and 2.5 mm, more preferable between 1.5 and 2.0 mm, for example 1.8 mm.

A purpose of the damping means is to protect the components of the borehole survey assembly during the percussive drilling. By the components of the borehole survey assembly can be meant for example at least one gyro sensor for generating a first signal indicative of angular rate and at least one acceleration sensor for generating a second signal indicative of acceleration along a borehole drilled by the drilling arrangement or a drilling arrangement and possible a piezoelectric device for harvesting electric energy during percussive drilling.

If the borehole survey assembly is provided with a piezoelectric device for harvesting electric energy during percussive drilling, the damping means of the borehole survey assembly are preferably, but not necessarily, tuned to create a correct oscillation frequency for the piezoelectric device during the percussive drilling so that the piezoelectric device is able to harvest electrical energy during percussive drilling.

LIST OF FIGURES

Figure 2:
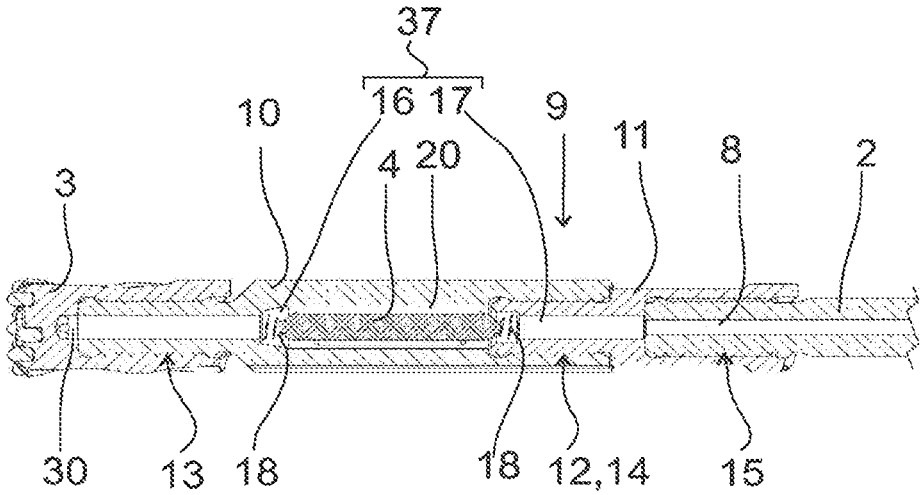
Figure 3:
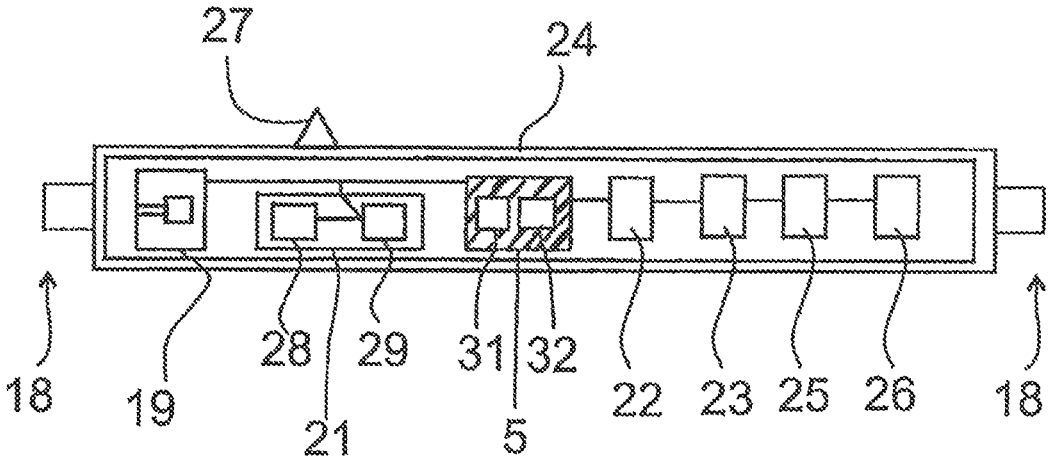
Figure 4:
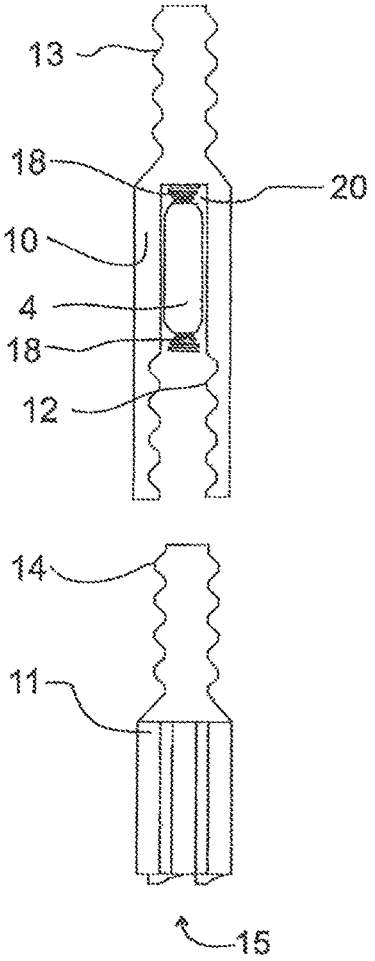
Figure 5:
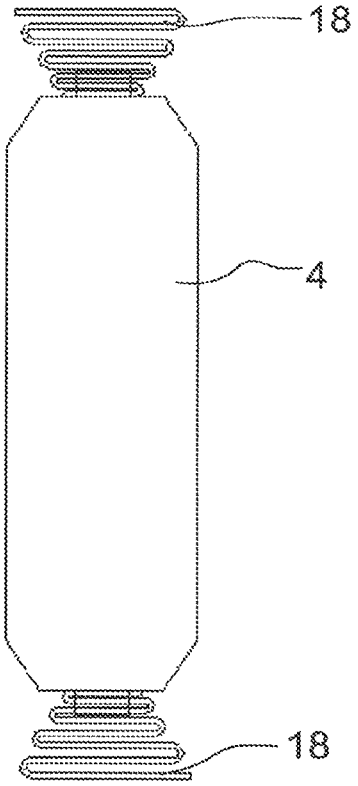
Figure 6:
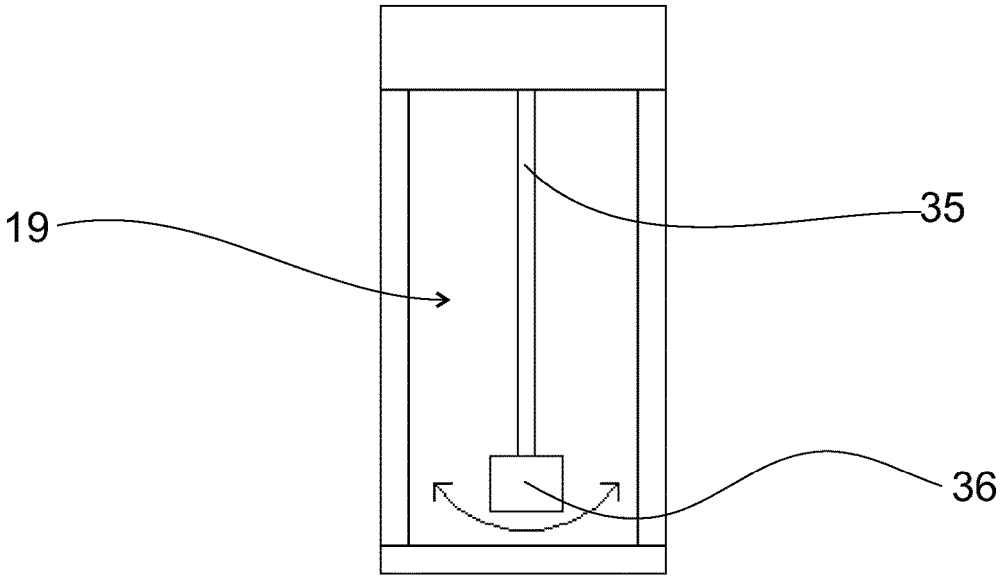
Figure 7:
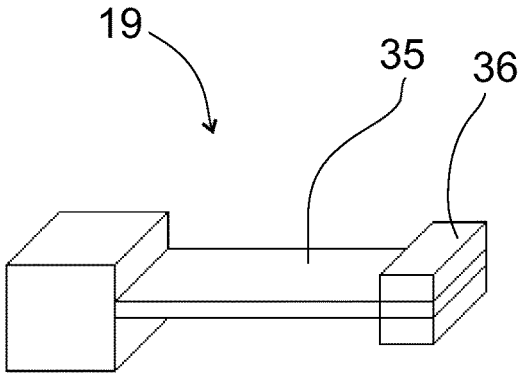

In the following the invention will described in more detail by referring to the figures, which FIG. 1 shows a drilling arrangement, FIG. 2 shows in cut view the end of a drill tool that is provided with a borehole survey assembly, FIG. 3 shows in cut view a borehole survey assembly according to one embodiment, FIG. 4 shows a first adapter part and a second adapter part which are used in some embodiments for fastening of the drill bit assembly to a drill rod of the drill tool, and FIG. 4 also show how a borehole survey tool can be arranged when such first adapter part and such second adapter part are used, FIG. 5 shows a borehole survey assembly according to another embodiment, FIG. 6 is a detail view of one embodiment a piezoelectric device that can be used in the borehole survey assembly for harvesting electrical energy during percussive drilling, and FIG. 7 is a more detailed view of the piezoelectric device shown in FIG. 6.

DETAILED DESCRIPTION OF THE INVENTION

The invention relates to a method for surveying drill holes, to a drilling arrangement, and to a borehole survey assembly for use in the method and/or in the arrangement.

First the method for surveying drill holes and some preferred embodiments and variants of the method will be described in greater detail.

The method comprises a first providing step for providing a drill tool 1 comprising at least one drill rod 2 and a drill bit assembly 3.

The method comprises additionally a second providing step for providing a borehole survey tool 4 comprising sensor means 5 for measuring a borehole 6.

The method comprises an arranging step for arranging the borehole survey tool 4 within the drill tool 1.

The method comprises a drilling step for drilling with the drill tool 1 a borehole 6 by a drilling process including at least percussive drilling.

The method comprises a measuring step for measuring the borehole 6 by means of the sensor means 5 of the borehole survey tool 4 to obtain data of the borehole 6.

The method may comprise a sending step for sending data of the borehole 6 from the borehole survey tool 4 to a data processing means 7 and a receiving step for receiving data of the borehole 6 by the data processing means 7. A wire or wireless connection (not shown in the drawings) may be used in the sending step and the receiving step. In a preferred embodiment of the method, the method comprises a saving step for storing data of the borehole 6 on a memory means 26 of the borehole survey tool 4 when the borehole survey tool 4 together with the drill tool is located at least partly in the borehole 6. In this preferred embodiment the sending step and the receiving step is performed after that the borehole survey tool 4 has been removed from the borehole 6 by transferring data of the borehole 6 from the memory means 26 to a data processing means 7.

The method comprises a processing step for processing data of the borehole 6 with a data processing means 7 to obtain borehole status information.

In the method, a drill tool 1 comprising a central flushing channel 8 for conducting flushing fluid such as flushing liquid and/or flushing gas to the drill bit assembly 3 is used and the borehole survey tool 4 is in the arranging step releasable or fixedly arranged in the central flushing channel 8 so that flushing fluid can flow in the central flushing channel 8 past the borehole survey tool 4 in the drill tool 1.

Because the borehole survey tool 4 is in the arranging step arranged in the central flushing channel 8, the borehole survey tool 4 will be cooled by flushing fluid flowing in the central flushing channel 8 of the drill tool 1.

The method may include using a drill bit assembly 3 comprising a flushing channel section 30, and the arranging step may include arranging the borehole survey tool 4 at least partly in the flushing channel section 30 of the drill bit assembly 3.

In some embodiments of the method, the first providing step of the method comprises providing additionally an adapter 9 comprising a central flushing channel section 37. In such embodiment the arranging step includes fastening the drill bit assembly 3 to a drill rod 2 of the drill tool 1 by means of the adapter 9 so that the central flushing channel section 37 of the adapter 9 forms a part of the central flushing channel 8 of the drill tool 1. In such embodiments, the arranging step includes arranging the borehole survey tool 4 at least partly in the central flushing channel section 37 of the adapter 9.

In some embodiments of the method, the first providing step of the method comprises providing additionally an adapter 9 comprising a first adapter part 10 and a second adapter part 11, so that the first adapter part 10 comprising a first female thread 12 and a first male thread 13 for fastening a drill bit assembly 3 to the first adapter part 10 of the adapter 9, and so that the second adapter 11 part comprising a second male thread 14 for cooperation with the first female thread 12 of the first adapter part 10 and a second female thread 15 for fastening the second adapter part 11 of the adapter 9 to a drill rod 2 of the drill tool 1, and so that the first adapter part 10 comprises a first central flushing channel part 16 and the second adapter part 11 comprises a second central flushing channel part 17. In such embodiments, the arranging step includes arranging the borehole survey tool 4 at least partly in the first central flushing channel part 16 of the first adapter part 10 and/or at least partly in the second central flushing channel part 17 of the second adapter part 11 and connecting the first adapter part 10 and the second adapter part 11 by means of the a first female thread 12 of the first adapter part 10 and by means of the second male thread 14 of the second adapter part 11. Such embodiments includes a fastening step for fastening the drill bit assembly 3 to a drill rod 2 of the drill tool 1 by means of the adapter 9 so that the first central flushing channel part 16 of the first adapter part 10 and the second central flushing channel part 17 of the second adapter part 11 together forms a part of the central flushing channel 8 of the drill tool 1.

The arranging step includes preferably, but not necessarily, suspending the borehole survey tool 4 in the central flushing channel 8 of the drill tool 1 between damping means 18. One purpose of the damping means 18 are to protect the sensor means 5 and other devices in the borehole survey tool 4 during the drilling step. The damping means used in the method comp preferably, but not necessarily, at least one of the following: Spring means, such as conical springs, made of a wire or the like having a thickness between 0.5 and 3.0 mm, hydraulic damping means, and pneumatic damping means. The damping means used in the method can for example comprise spring means, such as conical springs as is shown for example in FIGS. 4 and 5, made of a wire or the like having a thickness, such as a diameter, between 0.5 and 3.0 mm, preferable between 1.0 and 2.5 mm, more preferable between 1.5 and 2.0 mm, for example 1.8 mm. Conical springs are preferably, but not necessarily, used, because due to the construction of a conical spring, flushing fluid can more efficiently flow past a conical spring than a cylindrical spring. One reason for this is that the flow direction of the flushing fluid need to change less when flowing through a conical spring in the direction of the central of the conical spring than when flowing through a cylindrical spring in the direction of the central axis of the cylindrical spring. If spring means are used as damping means 18, two spring means are preferably, but not necessarily used, as shown for example in FIG. 2, so that each damping means 18 is arranged between an inner surface (not marked with a reference numeral) of the central flushing channel 8 and the borehole survey tool 4 so that the borehole survey tool 4 is suspended between the spring means.

The arranging step includes preferably, but not necessarily, suspending the borehole survey tool 4 in the central flushing channel 8 of the drill tool 1 between damping means 18 so that the damping means 18 are situated outside the borehole survey tool 4 in the central flushing channel 8 of the drill tool 1 so that the damping means 18 are exposed to flushing fluid flowing in the central flushing channel 8 of the drill tool 1 and so that the damping means 18 are in direct contact with flushing fluid flowing in the central flushing channel 8 of the drill tool 1.

In a preferred embodiment of the method, the arranging step includes suspending the borehole survey tool 4 in the central flushing channel 8 of the drill tool 1 between damping means 18 so that the borehole survey tool 4 is supported in the central flushing channel 8 of the drill tool 1 solely by means of said damping means 18. Such embodiment is especially advantageous in percussive drilling, because the sensor means 5 of the borehole survey tool 4 will be protected for example against excess vibrations.

In the second providing step of the method is preferably, but not necessarily, provided a borehole survey tool 4 having the sensor means 5 of the borehole survey tool 4 at least partly, preferably fully, embedded in polymer such as polyurethane so that the polymer at least partly embedding the sensor means 5 also at least partly, preferably fully, forms the outermost surface of the borehole survey tool 4 and such that the polymer at least partly embedding the sensor means 5 also at least partly, preferably fully, forms a protective casing 24 of the borehole survey tool 4. In such embodiment the borehole survey tool 4 will be exposed to flushing fluid flowing in the central flushing channel 8 of the drill tool 1. Because the polymer that at least partly embeds the sensor means 5 also at least party forms the outermost surface of the borehole survey tool 4, the flushing fluid flowing in the central flushing channel 8 of the drill tool 1 can effectively cool the sensor means 5 of the borehole survey tool 4.

The second providing step of the method may include providing a borehole survey tool 4 comprising at least one flushing fluid passage 20 for allowing flushing fluid to flow through the borehole survey tool 4 in the central flushing channel 8 of the drill tool 1.

The arranging step of the method may, as shown in FIGS. 2 and 4, include forming at least one flushing fluid passage 20 for flushing fluid between the borehole survey tool 4 and the side walls (not marked with a reference numeral) of the central flushing channel 8 for allowing flushing fluid to flow past the borehole survey tool 4 in the central flushing channel 8 of the drill tool 1.

The second providing step of the method may include providing a borehole survey tool 4 comprising a piezoelectric device 19 for harvesting energy, whereby the drilling step of the method includes harvesting energy during the drilling step by means of the piezoelectric device.

The second providing step of the method may include providing a borehole survey tool 4 comprising sensor means 5 including at least one gyro sensor 31 for generating a first signal indicative of angular rate, and at least one acceleration sensor 32 for generating a second signal indicative of acceleration along the borehole 6, whereby the measuring step includes measuring angular rate with at least one gyro sensor 31 and generating a first signal indicative of angular rate and whereby the measuring step includes measuring acceleration with at least one acceleration sensor 32 and generating a second signal indicative of acceleration along the borehole 6.

The method may additionally include a presenting step for presenting borehole status generated in the processing step.

In the method, the measuring step may be performed as the drill tool 1 is withdrawn from the borehole 6. In the method, the measuring step may be performed during the drilling step. In a preferred embodiment of the method, the drilling step includes a waiting period during which the drill tool 1 is kept in the borehole 6 stationary with respect to a longitudinal direction the borehole 6 i.e. a waiting period during which the drill tool 1 is kept in the borehole 6 stationary in place with respect to the depth of the borehole 6. In this preferred embodiment of the method the measuring step is performed during the waiting period of the drilling step.

Next the drilling arrangement for percussive drilling and some preferred embodiments and variants thereof will be described in greater detail.

The drilling arrangement comprises a drill tool 1 for drilling boreholes.

The drill tool 1 comprises at least one drill rod 2 and a drill bit assembly 3.

The drilling arrangement comprises a borehole survey tool 4 comprising sensor means 5 for measuring a borehole 6 drilled by the drill tool 1 to obtain data of a borehole 6 drilled by the drill tool 1, wherein the borehole survey tool 4 is arranged within the drill tool 1.

The drilling arrangement may comprise transmitting means 23 for sending data of the borehole 6 from the borehole survey tool 4 and second receiving means 33 for receiving data of the borehole 6 sent by the transmitting means 23. A wire or wireless connection (not shown) may be provided between the transmitting means 23 and the second receiving means 33. Alternatively or additionally the borehole survey tool 4 may comprise memory means 26 for storing data of a borehole 6 on the memory means 26 of the borehole survey tool 4 when the borehole survey tool 4 together with the drill tool 1 is located at least partly in a borehole 6 so that data of the borehole 6 can later be transferred to the data processing means 7 for example by connecting the memory means 26 to the data processing means 7 after that the borehole survey tool 4 together with drill tool 1 has been removed from the borehole 6.

The drilling arrangement comprises data processing means 7 for processing data of the borehole to obtain borehole status information.

The drill tool 1 comprises a central flushing channel 8 for conducting flushing fluid such as flushing liquid and/or flushing gas to the drill bit assembly 3 and the borehole survey tool 4 is releasable or fixedly arranged in the central flushing channel 8 so that fluid can flow in the central flushing channel 8 past the borehole survey tool 4.

Because the borehole survey tool 4 is arranged in the central flushing channel 8, the borehole survey tool 4 will be cooled by flushing fluid flowing in the central flushing channel 8.

The drill bit assembly 3 may comprise a flushing channel section 30, and the borehole survey tool 4 may be arranged at least partly in the flushing channel section 30 of the drill bit assembly 3.

In some embodiments of the drilling arrangement the drill tool 1 comprise additionally an adapter 9 comprising a central flushing channel section 37. In these embodiments the drill bit assembly 3 is fastened to a drill rod 2 of the drill tool 1 by means of the adapter 9 so that the central flushing channel section 37 of the adapter 9 forms a part of the central flushing channel 8 of the drill tool 1. In these embodiments the borehole survey tool 4 is arranged at least partly located in the central flushing channel section 37 of the adapter 9.

Some embodiments of the drilling arrangement such as the drilling arrangement partly shown in FIG. 2 comprise an adapter 9 comprising a first adapter part 10 and a second adapter part 11. In these embodiments the first adapter part 10 comprises a first female thread 12 and a first male thread 13 for fastening a drill bit assembly 3 to the first adapter part 10 of the adapter 9. In these embodiments the second adapter part 11 comprises a second male thread 14 for cooperation with the female thread 12 of the first adapter part 10 and a second female thread 15 for fastening the second adapter part 11 of the adapter 9 to a drill rod 2 of the drill tool 1. In these embodiments the first adapter part 10 comprises a first central flushing channel part 16 and the second adapter part 11 comprises a second central flushing channel part 17. In these embodiments the borehole survey tool 4 is arranged at least partly in the first central flushing channel part 16 of the first adapter part 10 and/or at least partly in the second central flushing channel part 17 of the second adapter part 11. In these embodiment the first adapter part 10 and the second adapter part 11 are connected by means of the a first female thread 12 of the first adapter part 10 and by means of the second male thread 14 of the second adapter part 11 and the drill bit assembly 3 is connected to a drill rod 3 by means of the adapter 9 i.e. by means of the first adapter part 10 and the second adapter part 11 so that first central flushing channel part 16 of the first adapter part 10 and the second central flushing channel part 17 of the second adapter part 11 together forms a part of the central flushing channel 8 of the drill tool 1.

The borehole survey tool 4 is preferably, but not necessarily, as shown in FIG. 2, suspended in the central flushing channel 8 of the drill tool 1 between damping means 18. Such damping means 18 comprises preferably, but not necessarily at least one of the following: spring means, such as conical springs, made of a wire or the like having a thickness between 0.5 and 3.0 mm, hydraulic damping means, and pneumatic damping means. Such damping means can for example comprise spring means, such as conical springs, made of a wire or the like having a thickness, such as a diameter, between 0.5 and 3.0 mm, preferable between 1.0 and 2.5 mm, more preferable between 1.5 and 2.0 mm, for example 1.8 mm. One purpose of the damping means 18 are to protect the sensor means 5 in the borehole survey tool 4 during percussive drilling. Such damping means 18 comprises preferably, but not necessarily at least one spring in the form of conical springs, as shown in FIGS. 4 and 5. Conical springs are preferably, but not necessarily, used, because due to the construction of a conical spring, flushing fluid can more efficiently flow past a conical spring than a cylindrical spring. One reason for this is that the flow direction of the flushing fluid need to change less when flowing through a conical spring in the direction of the central of the conical spring than when flowing through a cylindrical spring in the direction of the central axis of the cylindrical spring. If spring means are used as damping means 18, two spring means are preferably, but not necessarily used, as shown for example in FIG. 2, so that each damping means 18 is arranged between an inner surface (not marked with a reference numeral) of the central flushing channel 8 and the borehole survey tool 4 so that the borehole survey tool 4 is suspended between the spring means.

The damping means 18 are preferably, but not necessarily, situated outside the borehole survey tool 4 in the central flushing channel 8 of the drill tool 1 so that the damping means 18 are exposed to flushing fluid flowing in the central flushing channel 8 of the drill tool 1 and so that the damping means 18 are in direct contact with flushing fluid flowing in the central flushing channel 8 of the drill tool 1.

In an embodiment of the arrangement, the borehole survey tool 4 is suspended in the central flushing channel 8 of the drill tool 1 between damping means 18 so that the borehole survey tool 4 is supported in the central flushing channel 8 of the drill tool 1 solely by means of said damping means 18. Such embodiment is especially advantageous in percussive drilling, because the sensor means 5 of the borehole survey tool 4 will be protected for example against excess vibrations.

The sensor means 5 of the borehole survey tool 4 are preferably, but not necessarily, at least partly, preferably fully, embedded in polymer such as polyurethane so that the polymer at least partly embedding the sensor means 5 also at least partly, preferably fully, forms the outermost surface of the borehole survey tool 4 and so that the polymer at least partly embedding the sensor means 5 also at least partly, preferably fully, forms a protective casing 24 of the borehole survey tool 4. Because the polymer that at least partly embeds the sensor means 5 also at least party forms the outermost surface of the borehole survey tool 4, the flushing fluid flowing in the central flushing channel 8 of the drill tool 1 can effectively cool the sensor means 5 of the borehole survey tool 4.

The borehole survey tool 4 comprises preferably, but not necessarily, at least one flushing fluid passage for allowing flushing fluid to flow through the borehole survey tool 4.

The arrangement comprises preferably, but not necessarily, at least one flushing fluid passage 20 for flushing fluid between the borehole survey tool 4 and the flushing channel for allowing flushing fluid to flow past the borehole survey tool 4.

The borehole survey tool 4 comprises preferably, but not necessarily, a piezoelectric device 19 for harvesting energy during percussive drilling.

The borehole survey tool 4 comprises preferably, but not necessarily, sensor means 5 including at least one gyro sensor 31 for generating a first signal indicative of angular rate, and at least one acceleration sensor 32 for generating a second signal indicative of acceleration along the borehole 6.

The arrangement comprises preferably, but not necessarily, presenting means 34 for presenting borehole status information produced by the data processing means 7.

Next the borehole survey assembly (not marked with a reference numeral) for use in a method for percussive drilling such as in a method as described in this publication and/or in a drilling arrangement for percussive drilling such as in an arrangement as described in this publication and some preferred embodiments and variants of the borehole survey assembly will be described in greater detail.

The borehole survey assembly comprises a borehole survey tool 4 containing sensor means 5 for collecting data of a borehole 6.

The borehole survey assembly comprises additionally damping means 18 for suspending the borehole survey tool in a central flushing channel 8 of a drill tool 1 for percussive drilling between said damping means 18. Such damping means comprises preferably, but not necessarily at least one of the following: spring means, such as conical springs, made of a wire or the like having a thickness between 0.5 and 3.0 mm, hydraulic damping means and pneumatic damping means. Such damping means can for example comprise spring means, such as conical springs, made of a wire or the like having a thickness, such as a diameter, between 0.5 and 3.0 mm, preferable between 1.0 and 2.5 mm, more preferable between 1.5 and 2.0 mm, for example 1.8 mm. Conical springs are advantageous to use in the borehole survey assembly, because they have less impact on the flow of flushing fluid in the central flushing channel 8. Conical springs are preferably, but not necessarily, used, because due to the construction of a conical spring, flushing fluid can more efficiently flow past a conical spring than a cylindrical spring. One reason for this is that the flow direction of the flushing fluid need to change less when flowing through a conical spring in the direction of the central of the conical spring than when flowing through a cylindrical spring in the direction of the central axis of the cylindrical spring. If spring means are used as damping means 18, two spring means are preferably, but not necessarily used, as shown for example in FIG. 2, so that each damping means 18 is arranged between an inner surface (not marked with a reference numeral) of the central flushing channel 8 and the borehole survey tool 4 so that the borehole survey tool 4 is suspended between the spring means.

The damping means 18 are preferably, but not necessarily, situated outside the borehole survey tool 4.

The sensor means 5 of the borehole survey tool 4 are preferably, but not necessarily, at least partly, preferably fully, embedded in polymer such as polyurethane so that the polymer at least partly embedding the sensor means 5 also at least partly, preferably fully, forms the outermost surface of the borehole survey tool 4 and so that the polymer at least partly embedding the sensor means 5 also at least partly forms a protective casing 24 of the borehole survey tool 4. Because the polymer that at least partly embeds the sensor means 5 also at least party forms the outermost surface of the borehole survey tool 4, the flushing fluid flowing in the central flushing channel 8 of the drill tool 1 can effectively cool the sensor means 5 of the borehole survey tool 4.

Because the borehole survey tool 4 is to be suspended in a central flushing channel 8 of a drill tool 1, the borehole survey tool 4 will be cooled by flushing fluid flowing in the central flushing channel 8.

In the embodiment shown in FIGS. 2 to 5, the borehole survey tool 4 has an elongated configuration having two opposite ends, and one damping means 18 at each opposite end.

The borehole survey assembly comprises preferably, but not necessarily, a piezoelectric device 19 for harvesting energy during percussive drilling i.e. when the drill tool 1 and the components thereof (the drill rod(s) 2 and the drill bit assembly 3 and a possible adapter 9 between a drill rod 2 and the drill bit assembly 3) oscillates during percussive drilling. The borehole survey assembly comprises preferably, but not necessarily also energy storing means 21 for storing electrical energy produced by the piezoelectric device 19. Especially if surveying of the borehole 6 is performed as the drill tool 1 is withdrawn from the borehole, energy storing means 21 are of advantage, because this enables harvesting energy during percussive drilling by means of the piezoelectric device 19 when the borehole 6 is drilled and subsequently using the energy stored on the energy storing means 21 for the sensor means afterwards when the drill tool 1 is withdrawn from the borehole 6. The piezoelectric device 19 may comprise one or more piezoelectric apparatuses that may be of Unimorph-, Bimorph-, Monomorph-, or Multimorph-type. A such piezoelectric apparatus may be pre-strained and may be made for example of metal, polymer and/or ceramic material. A such piezoelectric apparatus may for example, as shown in FIGS. 6 and 7, comprise a flexible piezoelectric plate 35 that is fastened at one end or both ends to the borehole survey tool 4. A mass 36 for manually adjusting the resonation frequency may be fastened to the flexible piezoelectric plate. The mass 36 is preferably, but not necessarily, arranged eccentrically so that the mass 36 will move both as a result of rotation of the drill tool 1 and as a result of the oscillation of the drill tool 1. A coil (not shown in the figures) or a capacitor (not shown in the figures) may be provided for electrically adjusting the resonation frequency.

The energy storing means 21 for storing energy may comprise an accumulator 28 for storing energy and an inductive coil 29 for charging the accumulator 28, or a capacitor.

The sensor means 5 of the borehole survey assembly comprises preferably, but not necessarily, at least one gyro sensor 31 for generating a first signal indicative of angular rate, and at least one acceleration sensor 32 for generating a second signal indicative of acceleration along the borehole 6.

The borehole survey assembly comprises preferably, but not necessarily, first receiving means 22 for receiving control signals to control the operation of the borehole survey assembly.

The borehole survey assembly comprises preferably, but not necessarily, transmitting means 23 for transmitting data of a borehole 6.

The borehole survey assembly comprises preferably, but not necessarily, a protective casing 24, for example a polymer casing. A such protective casing is preferably but, not necessarily, dust- and watertight.

The borehole survey assembly comprises preferably, but not necessarily, holder 27 for preventing the borehole survey assembly from rotating when mounted in a central flushing channel 8 of a drill tool 1.

The borehole survey assembly comprises preferably, but not necessarily, a control means 25 for controlling the sensor means 5.

The borehole survey assembly comprises preferably, but not necessarily, memory means 26 for storing data of the borehole 6 produced by the sensor means 5 when the borehole survey assembly together with the drill tool 1 is located at least partly in a borehole 6.

It is apparent to a person skilled in the art that as technology advances, the basic idea of the invention can be implemented in various ways. The invention and its embodiments are therefore not restricted to the above examples, but they may vary within the scope of the claims.

LIST OF REFERENCE NUMERALS

1. Drill tool
2. Drill rod
3. Drill bit assembly
4. Borehole survey tool
5. Sensor means
6. Borehole
7. Data processing means
8. Central flushing channel
9. Adapter
10. First adapter part
11. Second adapter part
12. First female thread
13. First male thread
14. Second male thread
15. Second female thread
16. First central flushing channel part
17. Second flushing channel part
18. Damping means
19. Piezoelectric device
20. Flushing fluid passage
21. Energy storing means
22. First receiving means
23. Transmitting means
24. Protective casing
25. Control means
26. Memory means
27. Holder
28. Accumulator
29. Inductive coil
30. Flushing channel section
31. Gyro sensor
32. Acceleration sensor
33. Second receiving means
34. Display means
35. Flexible piezoelectric plate
36. Mass
37. Central flushing channel section

The invention claimed is:

1. A method for surveying drill holes, wherein the method comprises:

providing a drill tool having at least one drill rod and a drill bit assembly;

providing a borehole survey tool including a sensor for measuring a borehole;

arranging the borehole survey tool within the drill tool;

drilling with the drill tool a borehole by a drilling process including at least percussive drilling;

measuring the borehole by the borehole survey tool to obtain data of the borehole;

processing data of the borehole with a data processor including a non-transitory memory to obtain borehole status information, the drill tool having a central flushing channel for conducting flushing fluid to the drill bit assembly; and arranging the borehole survey tool in the central flushing channel so that flushing fluid can flow in the central flushing channel past the borehole survey tool, wherein arranging the borehole survey tool within the drill tool includes suspending the borehole survey tool in the central flushing channel of the drill tool between dampers so that the dampers are situated outside the borehole survey tool in the central flushing channel of the drill tool so that the dampers are configured to be exposed to flushing fluid flowing in the central flushing channel of the drill tool and so that the flushing fluid flowing in the central flushing channel of the drill tool flows through the dampers.

2. The method according to claim 1, comprising:

using the drill bit assembly having a flushing channel section; and arranging the borehole survey tool at least partly in the flushing channel section of the drill bit assembly.

3. The method according to claim 2, wherein the drill tool includes an adapter having a central flushing channel section and the arranging the borehole survey tool within the drill tool comprises:

fastening the drill bit assembly to the at least one drill rod of the drill tool by the adapter so that the central flushing channel section of the adapter forms a part of the central flushing channel of the drill tool; and wherein arranging the borehole survey tool in the central flushing channel section includes arranging the borehole survey tool at least partly in the central flushing channel section of the adapter.

4. The method according to claim 1, wherein the dampers are at least one of a spring damper made of a wire having a thickness between 0.5 and 3.0 mm, a hydraulic damper and a pneumatic damper.

5. The method according to claim 4, wherein arranging the borehole survey tool within the drill tool comprises:

suspending the borehole survey tool in the central flushing channel of the drill tool between the dampers so that the borehole survey tool is supported in the central flushing channel of the drill tool solely by said dampers.

6. The method according to claim 1, wherein the sensor of the borehole survey tool is at least partly embedded in polymer so that the polymer at least partly embedding the sensor also at least partly forms an outermost surface of the borehole survey tool and such that the polymer at least partly embedding the sensor also at least partly forms a protective casing of the borehole survey tool.

7. The method according to claim 5, wherein arranging the borehole survey tool within the drill tool comprises:

forming a passage for flushing fluid between the borehole survey tool and walls of the central flushing channel for allowing flushing fluid to flow past the borehole survey tool in the central flushing channel of the drill tool.

8. The method according to claim 6, wherein the borehole survey tool includes a piezoelectric device for harvesting energy, the method comprising:

harvesting energy during the percussive drilling by the piezoelectric device.

9. The method according to claim 1, comprising:

performing the measuring as the drill tool is withdrawn from the borehole.

10. The method according to claim 1, comprising:

performing the measuring during the drilling step.

11. The method according to claim 1, wherein the drilling includes a waiting period during which the drill tool is kept in the borehole stationary with respect to a longitudinal direction of the borehole, the method further comprising:

performing the measuring during the waiting period of the drilling.

12. A drilling arrangement for percussive drilling, comprising:

a drill tool for drilling boreholes, the drill tool having at least one drill rod and a drill bit assembly;

a borehole survey tool for measuring the borehole to obtain data of a borehole drilled by the drill tool, wherein the borehole survey tool is arranged within the drill tool;

a data processor including a non-transitory memory for processing data of the borehole to obtain borehole status information, the drill tool including a central flushing channel for conducting flushing fluid to the drill bit assembly; and the borehole survey tool being configured for arrangement in the central flushing channel so that fluid can flow in the central flushing channel past the borehole survey tool, the borehole survey tool being suspended in the central flushing channel of the drill tool between dampers wherein the dampers are situated outside the borehole survey tool in the central flushing channel of the drill tool so that the dampers are configured to be exposed to flushing fluid flowing in the central flushing channel of the drill tool and so that the flushing fluid flowing in the central flushing channel of the drill tool flows through the dampers.

13. The drilling arrangement according to claim 12, wherein the drill bit assembly comprises:

a flushing channel section; and the borehole survey tool being arranged at least partly in the flushing channel section of the drill bit assembly.

14. The drilling arrangement according to claim 13, comprising:

an adapter having a central flushing channel section, the drill bit assembly being fastened to the drill rod of the drill tool by the adapter so that the central flushing channel section of the adapter forms a part of the central flushing channel of the drill tool; and the borehole survey tool being arranged at least partly in the central flushing channel section of the adapter.

15. The drilling arrangement according to claim 12, wherein the dampers are at least one of the following: a spring damper made of a wire having a thickness between 0.5 and 3.0 mm, a hydraulic damper and a pneumatic damper.

16. The drilling arrangement according to claim 12, wherein the borehole survey tool is suspended in the central flushing channel of the drill tool between the dampers so that the borehole survey tool is supported in the central flushing channel of the drill tool solely by said dampers.

17. The drilling arrangement according to claim 12, comprising:

a sensor of the borehole survey tool is at least partly embedded in polymer so that the polymer at least partly embedding the sensor also at least partly forms an outermost surface of the borehole survey tool and so that the polymer at least partly embedding the sensor also at least partly forms a protective casing of the borehole survey tool.

18. The drilling arrangement according to claim 12, comprising:

at least one passage for flushing fluid between the borehole survey tool and the walls of the central flushing channel for allowing flushing fluid to flow past the borehole survey tool in the central flushing channel of the drill tool.

19. The drilling arrangement according to claim 12, the borehole survey tool comprising:

a piezoelectric device for harvesting energy during percussive drilling.

20. A borehole survey assembly for percussive drilling comprising:

a borehole survey tool containing a sensor for collecting data of a borehole; and two dampers for suspending the borehole survey tool in a central flushing channel of a drill tool for percussive drilling between said dampers;

wherein the dampers are situated outside the borehole survey tool in the central flushing channel of the drill tool so that the dampers are configured to be exposed to flushing fluid flowing in the central flushing channel of the drill tool and so that the flushing fluid flowing in the central flushing channel of the drill tool flows through the dampers.

21. The borehole survey assembly according to claim 20, wherein said dampers are at least one of the following: a spring damper made of a wire having a thickness between 0.5 and 3.0 mm, a hydraulic damper and a pneumatic damper.

22. The borehole survey assembly according to claim 20, wherein the borehole survey tool has an elongated form having two opposite ends, with one damper at each opposite end.

23. The borehole survey assembly according to claim 20, wherein the sensor of the borehole survey tool is at least partly embedded in polymer so that the polymer at least partly embedding the sensor also at least partly forms the outermost surface of the borehole survey tool and so that the polymer at least partly embedding the sensor also at least partly forms a protective casing of the borehole survey tool.

24. The borehole survey assembly according to claim 20, comprising:

a piezoelectric device for harvesting energy during percussive drilling.

25. The borehole survey assembly according to claim 24 comprising:

energy storing means for storing electrical energy produced by the piezoelectric device.

26. The borehole survey assembly according to claim 20, wherein the borehole survey tool comprises:

a protective casing.

* * * * *